US011490194B1

(12) United States Patent
Voishvillo et al.

(10) Patent No.: US 11,490,194 B1
(45) Date of Patent: Nov. 1, 2022

(54) OMNIDIRECTIONAL SPEAKER WITH AN INVERTED DOME DIAPHRAGM AND ASYMMETRIC VERTICAL DIRECTIVITY RESPONSE

(71) Applicant: Harman Professional, Inc., Northridge, CA (US)

(72) Inventors: Alexander Voishvillo, Simi Valley, CA (US); Richard D. Kamlet, Valencia, CA (US)

(73) Assignee: Harman Professional, Inc., Northridge, CA (US)

( * ) Notice: Subject to any disclaimer, the term of this patent is extended or adjusted under 35 U.S.C. 154(b) by 0 days.

(21) Appl. No.: 17/405,177

(22) Filed: Aug. 18, 2021

(51) Int. Cl.
*H04R 9/06* (2006.01)
*H04R 1/34* (2006.01)
*H04R 1/28* (2006.01)

(52) U.S. Cl.
CPC ..... *H04R 1/345* (2013.01); *H04R 1/2803* (2013.01); *H04R 1/34* (2013.01); *H04R 9/06* (2013.01); *H04R 2201/34* (2013.01); *H04R 2400/13* (2013.01)

(58) Field of Classification Search
CPC . H04R 1/20; H04R 1/34; H04R 1/345; H04R 1/2803; H04R 7/127; H04R 9/02; H04R 9/06; H04R 2201/34; H04R 2400/13
See application file for complete search history.

(56) References Cited

U.S. PATENT DOCUMENTS 4,975,965 A * 12/1990 Adamson ..... B32B 37/00 181/185
5,117,462 A * 5/1992 Bie ..... H04R 1/30 181/185
5,933,508 A * 8/1999 Fuke ..... H04R 1/30 381/430
6,064,745 A * 5/2000 Avera ..... H04R 1/30 181/152
6,744,899 B1 * 6/2004 Grunberg ..... H04R 1/30 381/343
10,645,488 B2 5/2020 Devantier
2003/0215107 A1 * 11/2003 Werner ..... H04R 1/30 381/343
2018/0054671 A1 2/2018 Voishvillo
2019/0028802 A1 1/2019 Chen

* cited by examiner

*Primary Examiner* — Huyen D Le
(74) *Attorney, Agent, or Firm* — Angela M. Brunetti

(57) ABSTRACT

A compression driver for an omnidirectional loudspeaker having an inverted dome diaphragm, a phasing plug having a top portion facing a convex surface of the inverted dome diaphragm and a plurality of concentric apertures that cooperate with the convex surface of the inverted dome diaphragm. Each aperture has a predetermined radial width and is spaced a predetermined concentric distance from an adjacent aperture converging at an exit of the phasing plug. The compression driver has a dispersion control assembly mounted to the bottom portion of the phasing plug along the central axis.

18 Claims, 16 Drawing Sheets

OMNIDIRECTIONAL SPEAKER WITH AN INVERTED DOME DIAPHRAGM AND ASYMMETRIC VERTICAL DIRECTIVITY RESPONSE

CROSS-REFERENCE TO RELATED APPLICATION

The present disclosure is related to and filed simultaneously with U.S. application Ser. No. 17/405,197 Omnidirectional Speaker with Inverted Dome Diaphragm And Separate Exits.

TECHNICAL FIELD

The present disclosure relates to an omnidirectional speaker with an inverted dome diaphragm and asymmetric vertical directivity.

BACKGROUND

Omnidirectional loudspeakers can generally be split into two types, those with symmetric vertical directivity and those with asymmetric vertical directivity. Loudspeakers with asymmetric vertical directivity are typically ceiling, pendant, and bollard electroacoustic systems that are positioned above a listening plane of a listener.

Sound coverage of loudspeakers may be characterized by stating their directivity which is usually a positive number that represents how quickly a sound pressure level (SPL) attenuates as the listener moves off-axis. Directivity may be depicted by polar coverage, which is a circle of equal distance away from the loudspeaker. When the polar coverage is projected onto a listening plane, it adds even more distance that the listener is from the sound source, and the SPL is, in effect, attenuated even more. Because sound attenuates with distance, ceiling and pendant loudspeakers generally have limited coverage. The sound is louder when a listener is directly below a loudspeaker. However, because the listener is already positioned at a vertical distance away from the radiation point, when the listener moves off-axis, the sound attenuates even more.

With the coverage of ceiling and pendant omnidirectional loudspeakers being so limited, sound systems that use ceiling and pendant speakers generally require many speakers, spaced a distance from each other, so that when the listener moves away from one speaker and the sound pressure level decreases, then the next loudspeaker takes over. This is called a distributed loudspeaker system. However, the distributed system has disadvantages. For example, there is never ideal summation between adjacent speakers, meaning the SPL is inconsistent. Also, the frequency response tends to change as the listener moves off-axis. Therefore, depending on where the listener is located, a different SPL and a different character of sound will be heard. This inconsistency is undesirable in a sound system.

One solution to optimize the consistency and improve the sound system is to increase the number of speakers in the system. Also, the distributed speaker system requires connection to a power amplifier. Adding more speakers to optimize the system increases the requirements for the power amplifier. It also adds complexity, cost of materials and labor costs.

There is a need for a high-efficiency omnidirectional speaker having flexible control of directivity response in a vertical plane that provides down-tilt coverage for a sound source located above the plane of the listener sends higher SPL toward the direction of listeners located farther away (i.e., off-axis) from the sound source than is sent toward listeners that are positioned just below the speaker.

SUMMARY

A compression driver for an omnidirectional loudspeaker having an inverted dome diaphragm, a phasing plug having a top portion facing a convex surface of the inverted dome diaphragm and a plurality of concentric apertures that cooperate with the convex surface of the inverted dome diaphragm. Each aperture has a predetermined radial width and is spaced a predetermined concentric distance from an adjacent aperture converging at an exit of the phasing plug. The compression driver has a dispersion control assembly mounted to the bottom portion of the phasing plug along the central axis.

A waveguide for an omnidirectional loudspeaker having a phasing plug having a top portion cooperating with a convex surface of an inverted dome diaphragm and a bottom portion extending downwardly from the top portion along a central axis. The phasing plug has a plurality of concentric apertures that cooperate with a compression chamber between the convex surface of the inverted dome diaphragm and the top portion of the phasing plug. Each aperture has a predetermined radial width and is spaced a predetermined concentric distance from an adjacent aperture. The concentric apertures converge at a single annular opening in the bottom portion. A dispersion control assembly mounted to the bottom portion of the phasing plug along the central axis, the dispersion control assembly has a top portion and a bottom portion, the bottom portion is spaced a distance from and received within a cavity of the top portion forming an annular pathway for sound to radiate.

An omnidirectional loudspeaker having a first horn and a compression driver attached to the first horn. The compression driver has an inverted dome diaphragm, a phasing plug mounted to the motor assembly. A top portion of the phasing plug faces a convex surface of the inverted dome diaphragm, and a bottom portion of the phasing plug extends downward from the top portion along the central axis. Concentric apertures extend through the phasing plug. Each aperture has a predetermined radial width and is spaced a predetermined concentric distance from an adjacent aperture. The concentric apertures converge into a single annular exit in the bottom portion of the phasing plug. A dispersion control assembly is mounted to the bottom portion of the phasing plug along the central axis forming an annular pathway for sound to radiate.

Elements and steps in the figures are illustrated for simplicity and clarity and have not necessarily been rendered to scale or according to any sequence. For example, steps that may be performed concurrently or in different order are illustrated in the figures to help to improve understanding of embodiments of the present disclosure.

DETAILED DESCRIPTION

While various aspects of the present disclosure are described with reference to FIGS. 1-13, the present disclosure is not limited to such embodiments, and additional modifications, applications, and embodiments may be implemented without departing from the present disclosure. In the figures, like reference numbers will be used to illustrate the same components. Those skilled in the art will recognize that the various components set forth herein may be altered without varying from the scope of the present disclosure.

Figure 1:
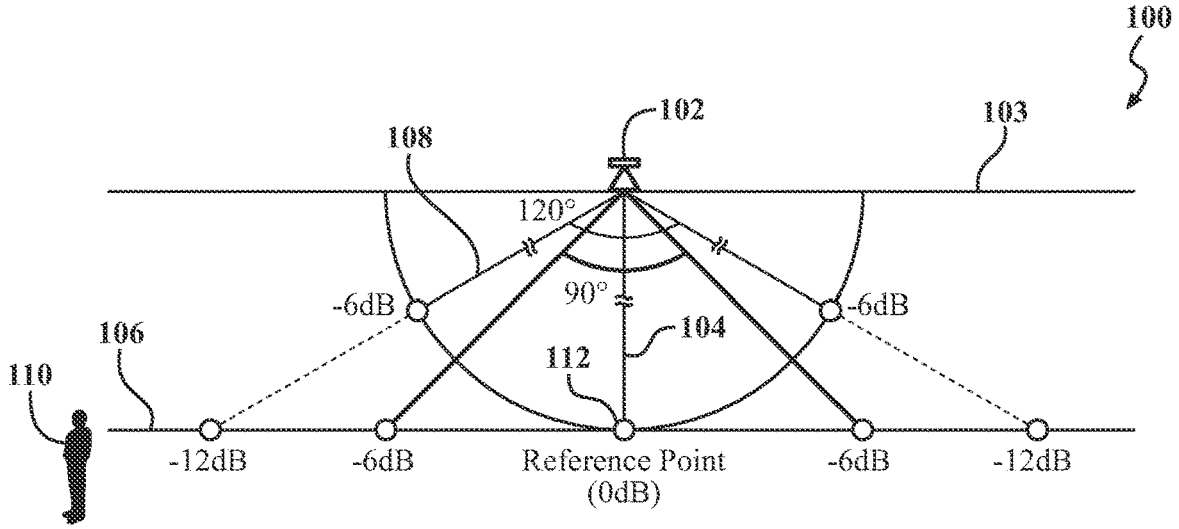
FIG. 1 PRIOR ART
FIG. 1. is a diagram showing a difference between polar coverage and listening plane coverage with a traditional ceiling speaker.

FIG. 1 is a diagram 100 that shows changes in polar coverage angle 104 for a prior art ceiling speaker 102 projected onto a listening plane 106. In the example shown in FIG. 1, the speaker 102 is installed in a ceiling 103. A reference point 112, 0 dB, on the listening plane 106 is located directly below the speaker 102. The coverage angle is the angle enclosed by −6 dB points on the polar plot. At −6 dB, the traditional speaker has a coverage angle 108 of 120°. However, the listening plane 106 generally coincides with an ear level of a listener 110 and is a vertical distance below the ceiling 103. When the listener 110 is directly below the speaker, directivity index has a factor of 0 dB, and the listener experiences a maximum SPL. As the listener 110 moves farther off-axis from the reference point 112, SPL is attenuated. When polar coverage 104 is projected onto the listening plane 106, sound is attenuated and the coverage angle 108 goes from 120° down to 90°.

Figure 2:
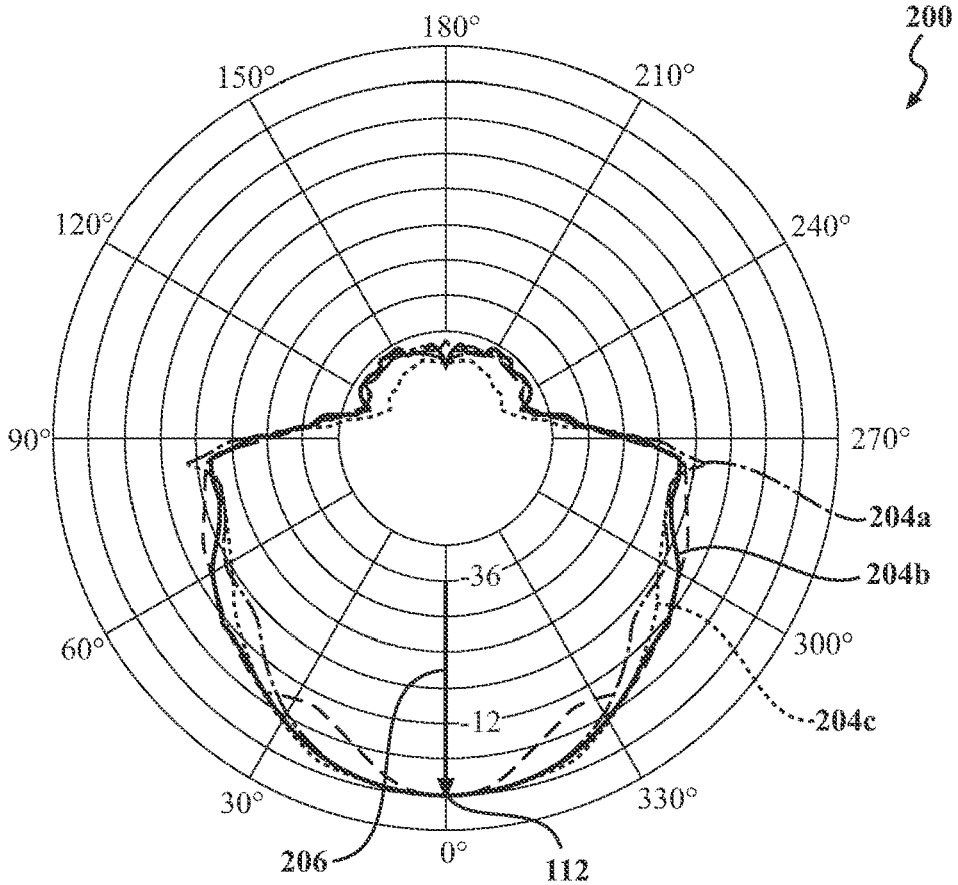
FIG. 2 PRIOR ART
FIG. 2 is a polar diagram for the speaker of FIG. 1.

FIG. 2 is a polar plot 200 for the traditional loudspeaker 102 at several frequencies 204*a*, 204*b*, 204*c*. Arrow 206 depicts a direction directly below the speaker 102 at the reference point 112 where SPL is at a maximum for the example frequencies 204*a-c*. Arrow 206 depicts maximum SPL in a direction directly below the speaker 102 for the various frequencies 204*a-c*. But the directivity is not constant and off-axis from the reference point SPL is attenuated.

Figure 3:
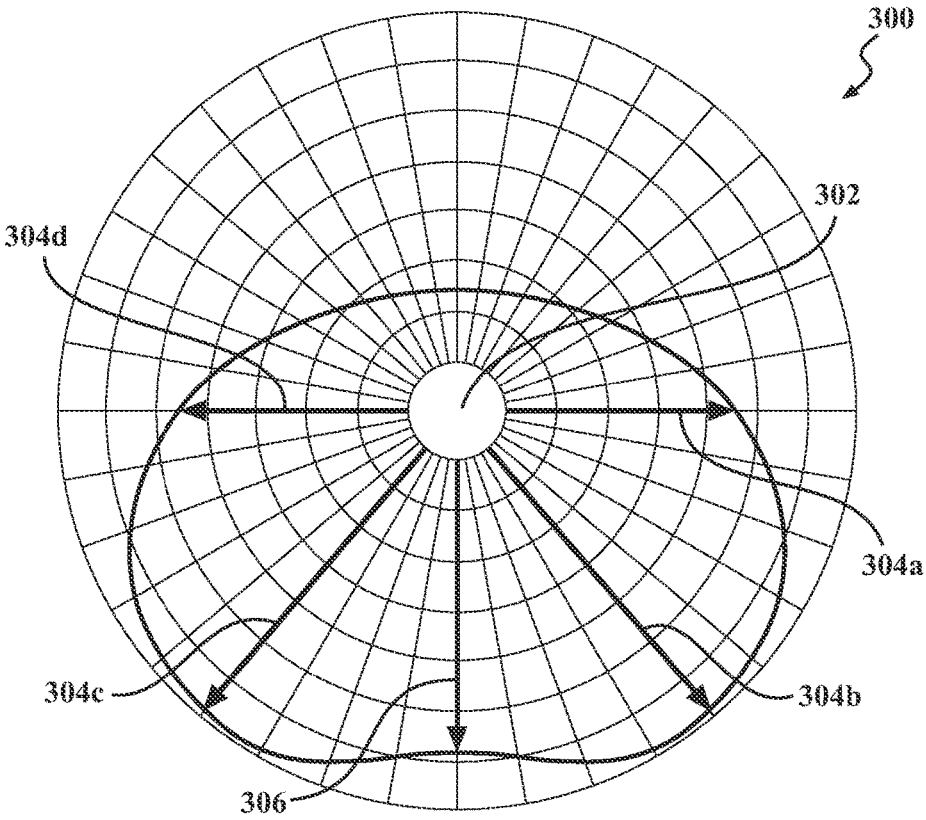
FIG. 3 is a polar diagram for one or more embodiments of the inventive subject matter.

The inventive subject matter is a compression driver, or speaker, having a waveguide that sends more sound to farther off-axis coverage areas below the speaker. The inventive subject matter has a negative directivity, when viewed in a polar manner, that increases sound level as a listener below the speaker moves off axis. FIG. 3 is a polar plot 300 showing polar coverage for a speaker 302 of the inventive subject matter. Sound level is being sent in various directions from the speaker 302, with four different directions, 304*a*, 304*b*, 304*c*, and 304*d*, being shown. Referring to FIG. 2, reference arrow 206, directly below the speaker 102, is the maximum sound pressure level as compared to the level off-axis from the reference point 112. In comparison, the polar plot 300 of FIG. 3 shows the sound being sent in the direction of arrow 306, directly below the speaker 302, is lower in volume than the sound being sent in the other directions 304*b* and 304*c*. More sound is being sent to farther off-axis coverage areas.

Figure 4:
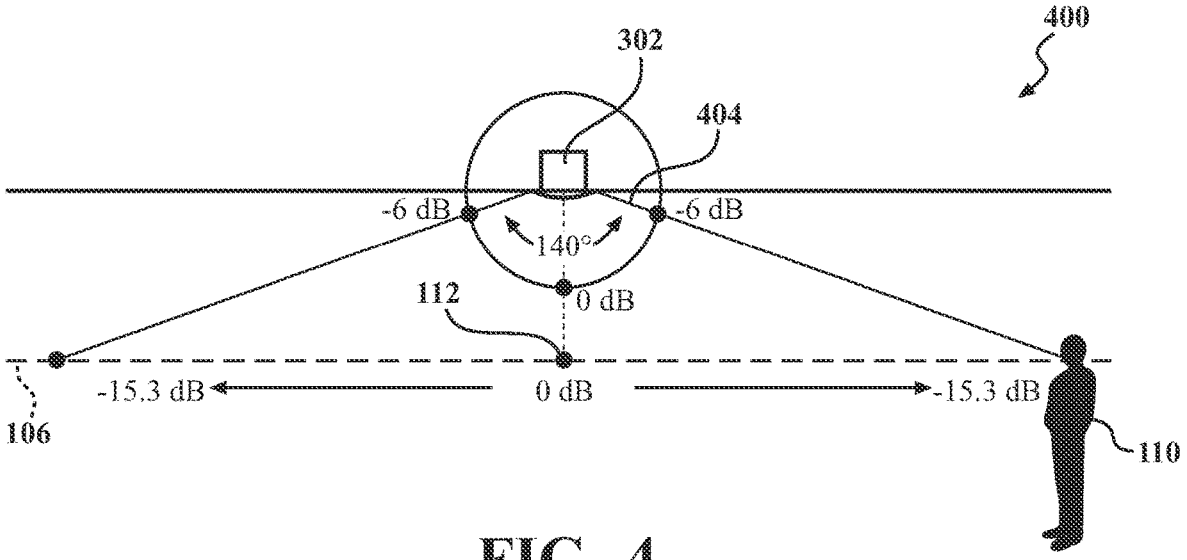
FIG. 4 is a diagram showing polar coverage and listening plane coverage for one or more embodiments of the inventive subject matter.

With negative directivity, the polar coverage increases to 140°. FIG. 4 is diagram 400 showing a polar coverage 404 for the speaker 302 with negative directivity. When polar coverage 404 is projected from the speaker 302 onto the listening plane 106, as shown in FIG. 4, the result is a much wider and more consistent SPL. The factors of 1) moving off-axis and 2) the increasing the SPL as the listener moves farther away from the speaker 302 cancel each other out until a point at which a final edge of the speaker's coverage is reached. The result is a usable coverage angle of 140°, an increase from the 90° coverage angle of the prior art ceiling speaker 102 shown in FIG. 1.

Figure 5A:
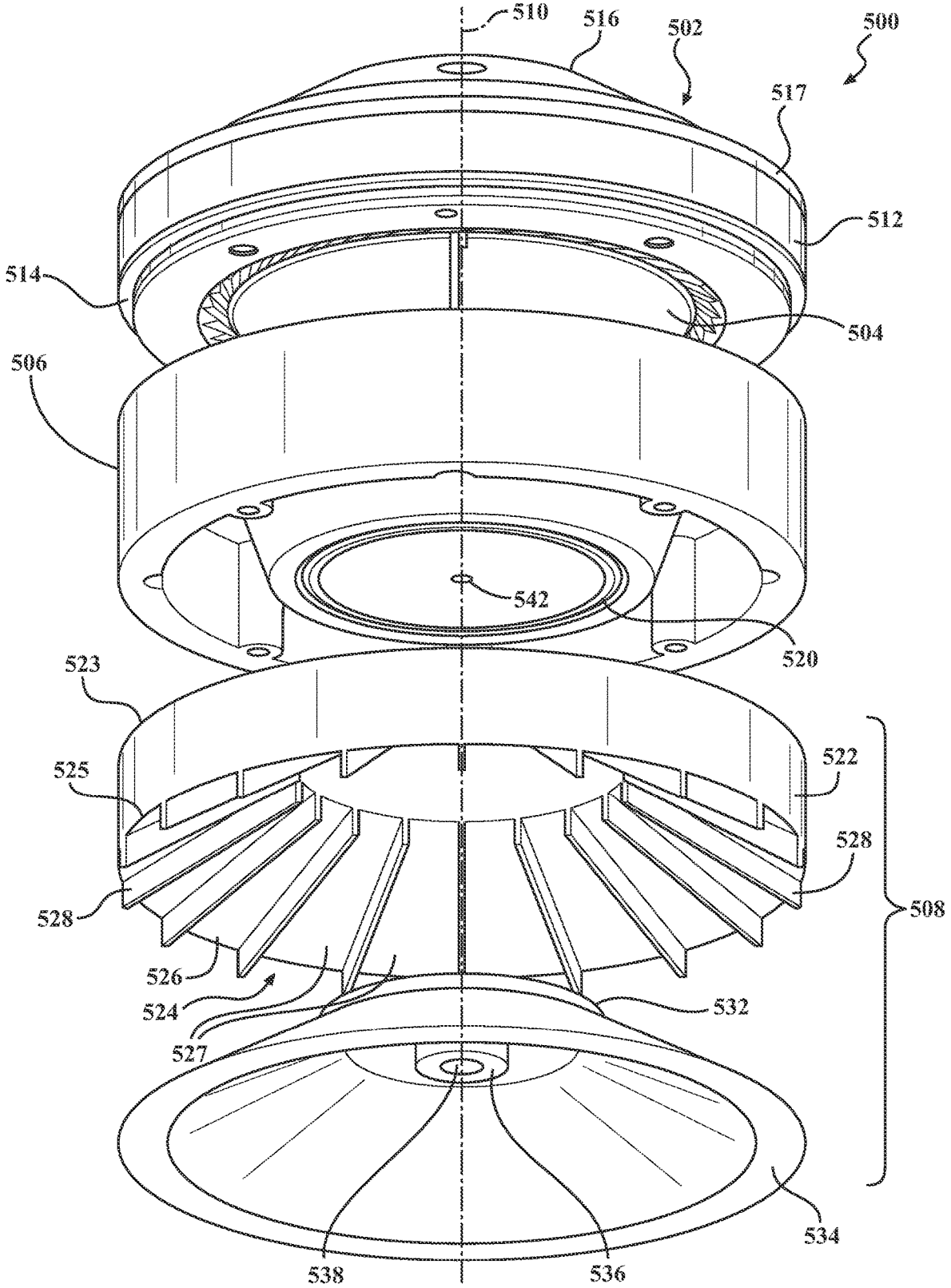
FIG. 5A is an exploded view of the compression driver showing one or more embodiments.
Figure 5B:
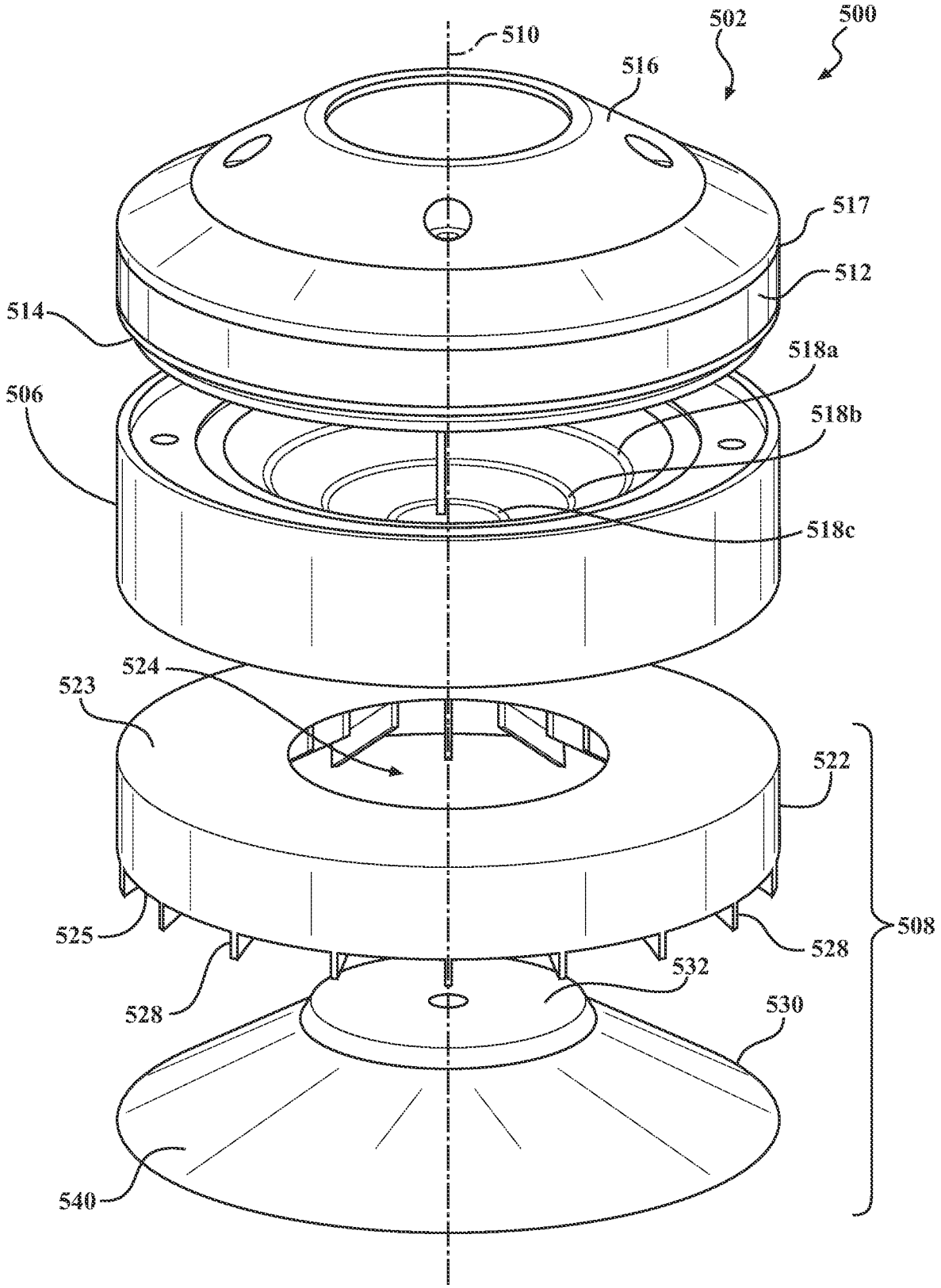
FIG. 5B is an exploded view of the compression driver showing one or more embodiments.

To accomplish negative directivity, a compression driver 500, shown in an exploded perspective view FIGS. 5A and 5B, includes a motor assembly 502, an inverted dome diaphragm 504 disposed below and operably connected to the motor assembly 502, a phasing plug 506 mounted to the motor assembly 502, and an optional dispersion control assembly 508 mounted to the phasing plug 506. The motor assembly 502, inverted dome diaphragm 504, phasing plug 506 and dispersion control assembly 508 are all coaxially along a central axis 510. A compression chamber (not shown in FIGS. 5A and 5B is a thin layer of air between the inverted dome diaphragm 504 and the phasing plug 506. The air gap is uniform along the entire length of the compression chamber. The inverted dome diaphragm 504 has a convex surface from which the audio signal exits into the compression chamber where it is picked up by the phasing plug 506.

In one or more embodiments, the motor assembly 502 may comprise an annular permanent magnet 512 disposed between a top plate 514 and a domed back plate 516 that includes a centrally disposed cylindrical or annular pole piece 517. The motor assembly 502 has a permanent magnet field for electrodynamic coupling with a voice coil 507 (not shown in FIG. 5A), wherein the voice coil is mechanically coupled to the inverted dome diaphragm 504 to convert electrical signals into sound waves. The motor assembly 502, the inverted dome diaphragm 504, the phasing plug 506, and the dispersion control assembly 508 may be connected by fasteners or adhesives.

FIG. 5B is an exploded view of the compression driver 500 from an alternate perspective. From this view, concentric apertures 518*a*, 518*b*, and 518*c* are visible in phasing plug 506. The inverted dome diaphragm 504 and the concentric apertures of the phasing plug 506 suppress radial resonances inside the compression chamber and provide equal pathlengths to avoid cancellation effect at high frequencies. According to the inventive subject matter, the concentric apertures exit on the convex side of the inverted dome diaphragm 504. The concentric apertures 518*a*, 518*b*, 518*c*, converge or consolidate at exit 520. The arrangement of the concentric apertures 518*a-c* and exits will be described in detail later herein.

In the example embodiment of FIGS. 5A and 5B, the dispersion control assembly 508 has a top portion 522 and a bottom portion 530. The top portion 522 has first 523 and second 525 ends and an opening 524 arranged generally circumferentially about the central axis 510. The opening 524 is smaller at the first end 523 than the second end 525. The opening 524 aligns with the exit 520 of the phasing plug 506. An inner surface 526 of the bottom portion 522 has a plurality of arms 528 extending downwardly and outwardly from the opening 524 to create radial channels 527. The exit 520 of the phasing plug 506 coincides with the opening 524 of the bottom portion 530 and the plurality of arms 528 evenly distribute sound pressure around the entirety of the compression driver 500 for directing sound downwards and outwards.

The bottom portion 530 of the dispersion control assembly 508 is received within and attaches to the inner surface 526 of the top portion 522. The bottom portion of the dispersion control assembly 508 has a top end 532 attached to the phasing plug 506 through the opening 524 of the top portion 522. A bottom end 534 of the bottom portion 530 may have a downwardly extending boss 536 with a central bore 538 for mounting the bottom portion 530 to a central bore 542 on the phasing plug 506. As shown, the bottom portion 530 may be generally frustoconical in shape, where an outer surface 540 of the bottom portion 530 may have a generally straight, smooth contour from the top end 532 to the bottom end 534.

Figure 6A:
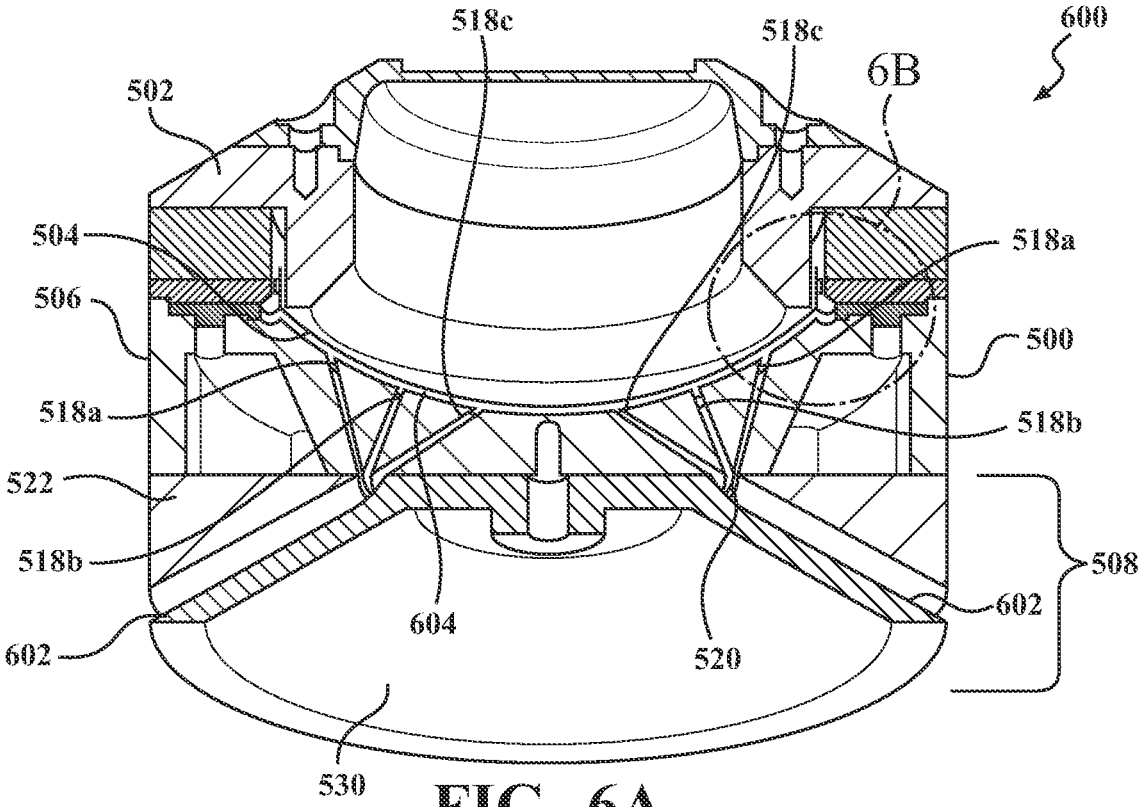
FIG. 6A is a cutaway view of the compression driver showing one or more embodiments.
Figure 6B:
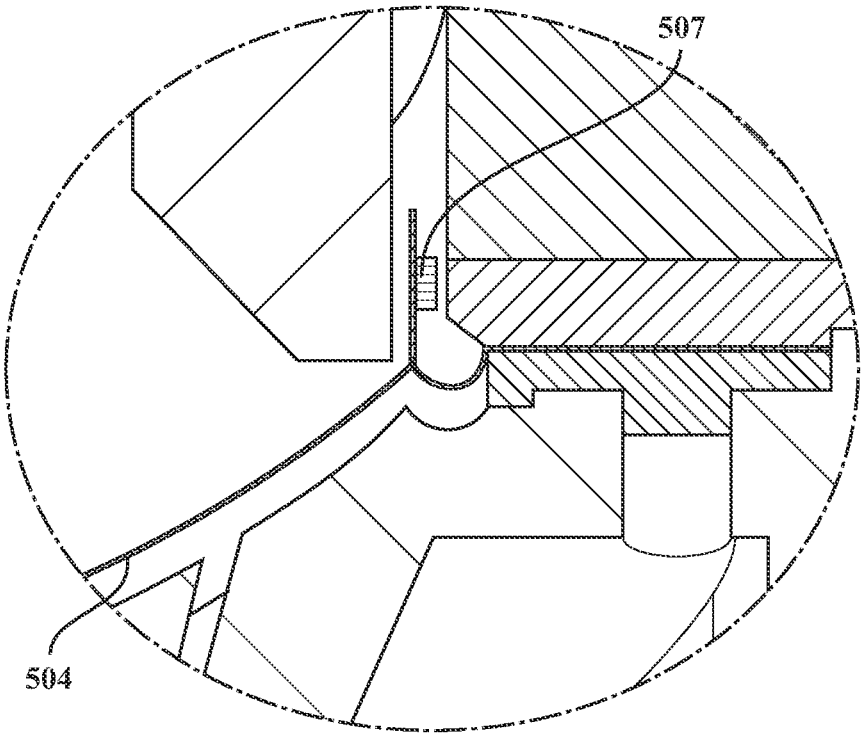
FIG. 6B is a close-up view of the inverted dome diaphragm and voice coil.

Referring now to FIGS. 6A and 6B, a cutaway view 600 of the compression driver 500 is shown and the concentric apertures 518*a-c* and a close-up view of the inverted dome diaphragm 504 and voice coil 507 are described in detail hereinafter. Apertures, or slots, 518*a*, 518*b*, and 518*c* are concentric and all converge at the same point, an exit 520. When assembled, the top 522 and bottom portions 530 of the dispersion control assembly 508 form a waveguide 602. The bottom portion 530 is spaced a distance from the top portion 522 creating the waveguide 602 for sound to travel outwards and downwards along the radial channels 527 (not shown in FIG. 6).

Figure 7:
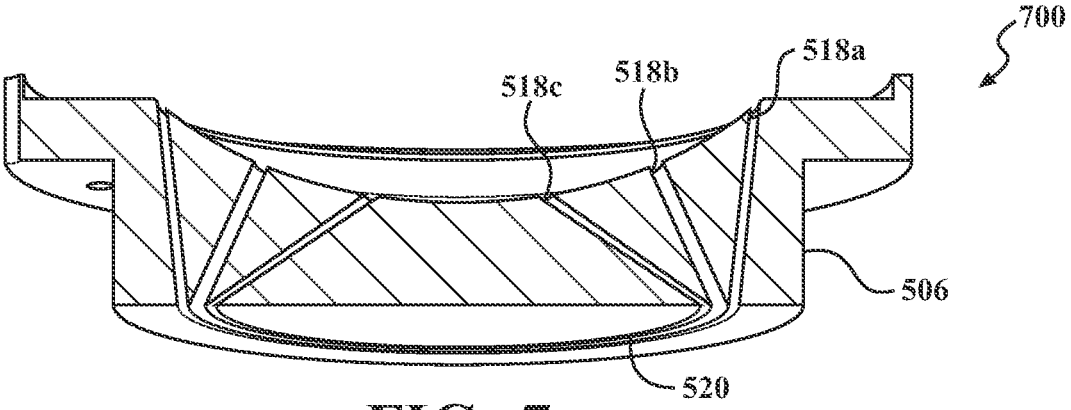
FIG. 7 is a cutaway view of one or more embodiments of the phasing plug.

FIG. 7 is a cutaway view 700 of the phasing plug 506 showing one or more embodiments in which the concentric apertures 518*a*, 518*b* and 518*c* converge at exit 520. The radial positions, widths and number of concentric apertures are determined by requirement to maximum efficiency of the driver and the through solution of the nonhomogeneous Helmholtz equation in spherical coordinates with the Neumann boundary condition at a periphery 604 of the compression chamber. In one or more embodiments three concentric apertures 518*a-c* of the phasing plug 506 are consolidated at exit 520 and then the acoustical signal is directed downward and sideways into the dispersion control assembly 508. The compression driver has symmetric directivity in a horizontal plane and non-symmetric directivity in a vertical plane. The dispersion control assembly 508 (not shown in FIG. 7) and the phasing plug 506 are arranged to direct the acoustic signal downwards and sideways.

Referring again to FIG. 6A, the radial position, width, and number of apertures in the plurality of apertures 518*a-c* may vary and is determined by the requirement for maximum efficiency of the driver and the through solution of the nonhomogeneous Helmholtz equation in spherical coordinates with the Neumann boundary condition at a periphery 604 of the compression chamber. In one or more embodiments three concentric apertures 518*a-c* of the phasing plug 506 converge at exit 520 and then the acoustical signal is directed downward and sideways into the dispersion control assembly 508. The compression driver 502 has symmetric directivity in a horizontal plane and non-symmetric directivity in a vertical plane. The dispersion control assembly 508 is arranged to direct the acoustic signal downwards and sideways. The number of apertures in the phasing plug 506 is equal to the number of the first resonances in the compression chamber to be suppressed. For example, the phasing plug 506 of FIG. 7 suppresses the first three resonances.

Figure 8:
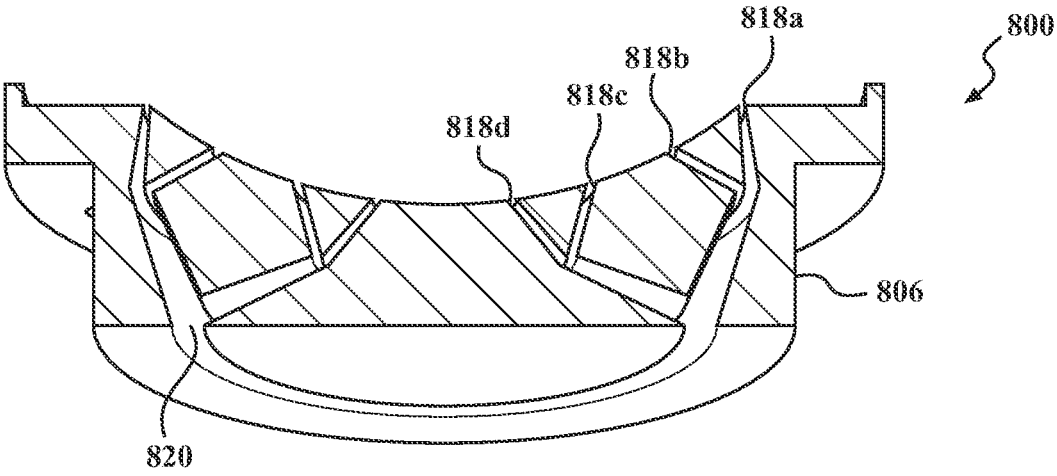
FIG. 8 is a cutaway view of one or more embodiments of the phasing plug.

FIG. 8 is a cutaway view of one or more embodiments of a top portion 821 of a phasing plug 806 with four concentric apertures 818*a*, 818*b*, 818*c*, and 818*d*. Depending on the dimensions of the dome and the radial dimensions of the acoustical compression chamber, there may be a different number of apertures. For example, for a small driver two apertures may be sufficient. More apertures may be needed in instances where two or three apertures are insufficient to suppress chamber resonances. For example, for larger drivers. In the embodiment shown in FIG. 8 the four concentric apertures merge within the top portion into a single annular exit 820 to the bottom portion (not shown). The phasing plug 806 of FIG. 8 works over a wider frequency range and can suppress the first four resonances. In the one or more embodiments shown in FIG. 8, the concentric apertures 818*a-d* do not all converge at the same point. Apertures 818*a* and 818*b* converge at a point. Apertures 818*c* and 818*d* converge at a different point. Eventually, all the apertures 818*a-d* merge into the single exit 820, however, the convergence occurs at different points in the top portion 821 of the phasing plug 806.

Figure 9A:
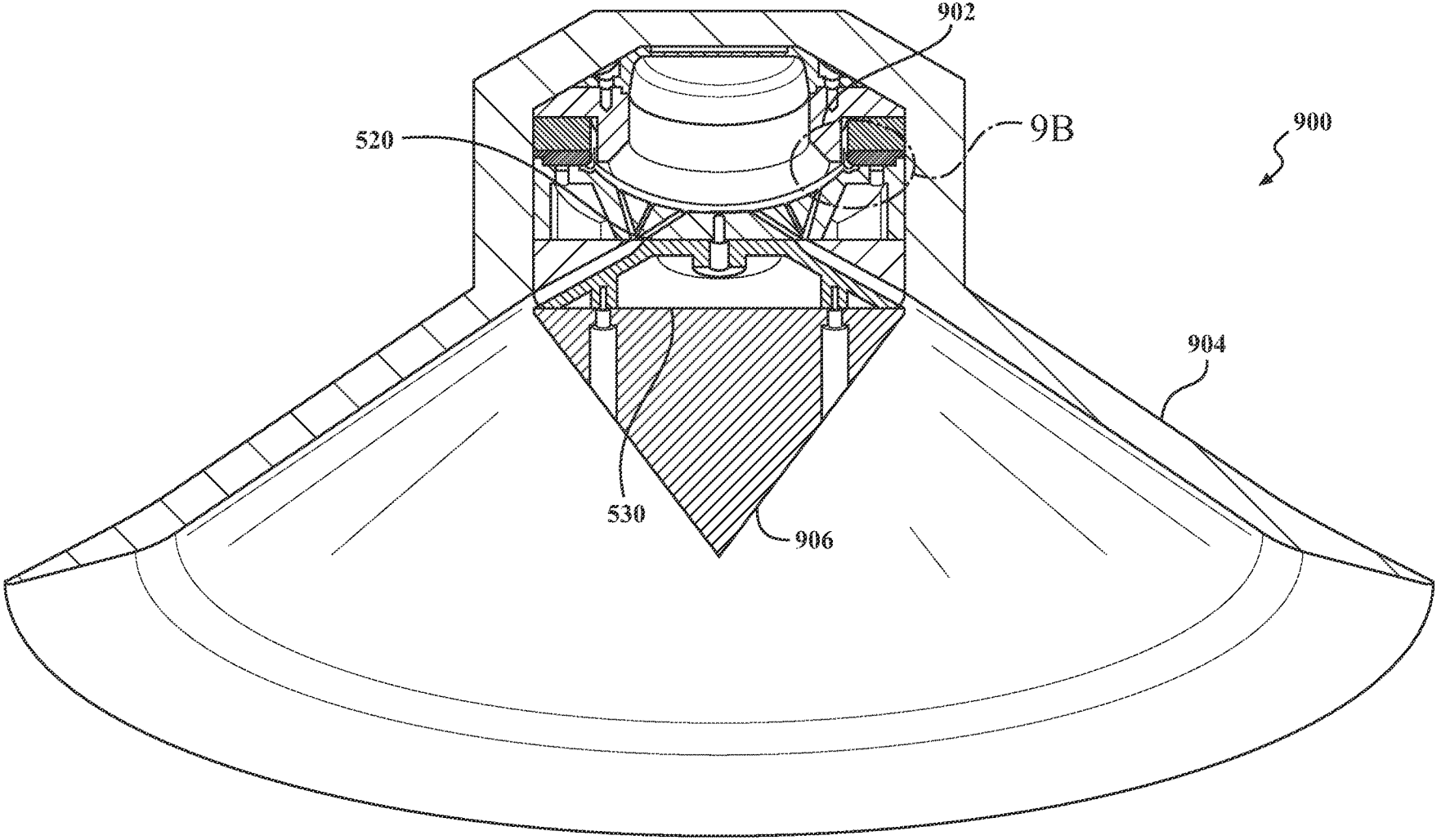
FIG. 9A is a cutaway view of one or more embodiments of the driver loaded by a horn.
Figure 9B:
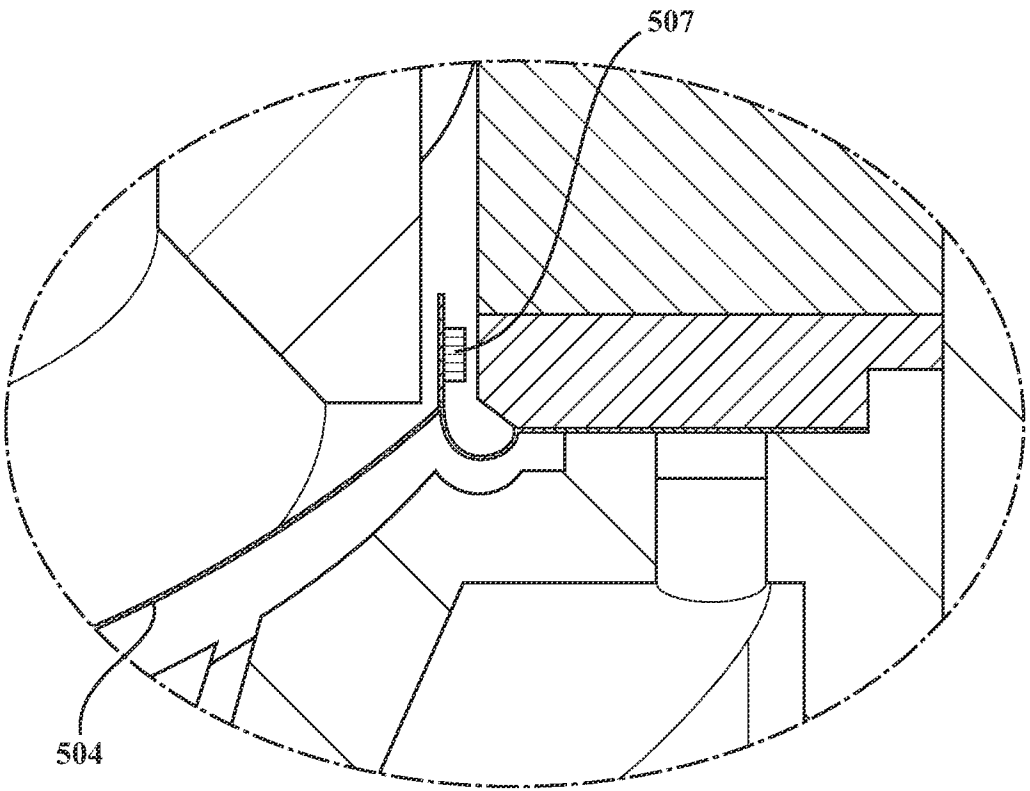
FIG. 9B is a close-up view of the inverted dome diaphragm and voice coil.

In one or more embodiments, shown in FIG. 9, the coverage in the vertical plane and ratios of SPL underneath and a distance from the compression driver may be modified with additions to the compression driver. For example, in one or more embodiments 900 shown in FIG. 9A, the compression driver 902 is loaded by a horn 904. The horn 904 may have a bullet tweeter 906 to further lower the sound pressure level directly underneath the loudspeaker and providing directivity through the exit 520. The bullet tweeter 906 is secured to the bottom portion 530. FIG. 9B is a close-up view of the inverted dome diaphragm 504 and voice coil 507.

Figure 10A:
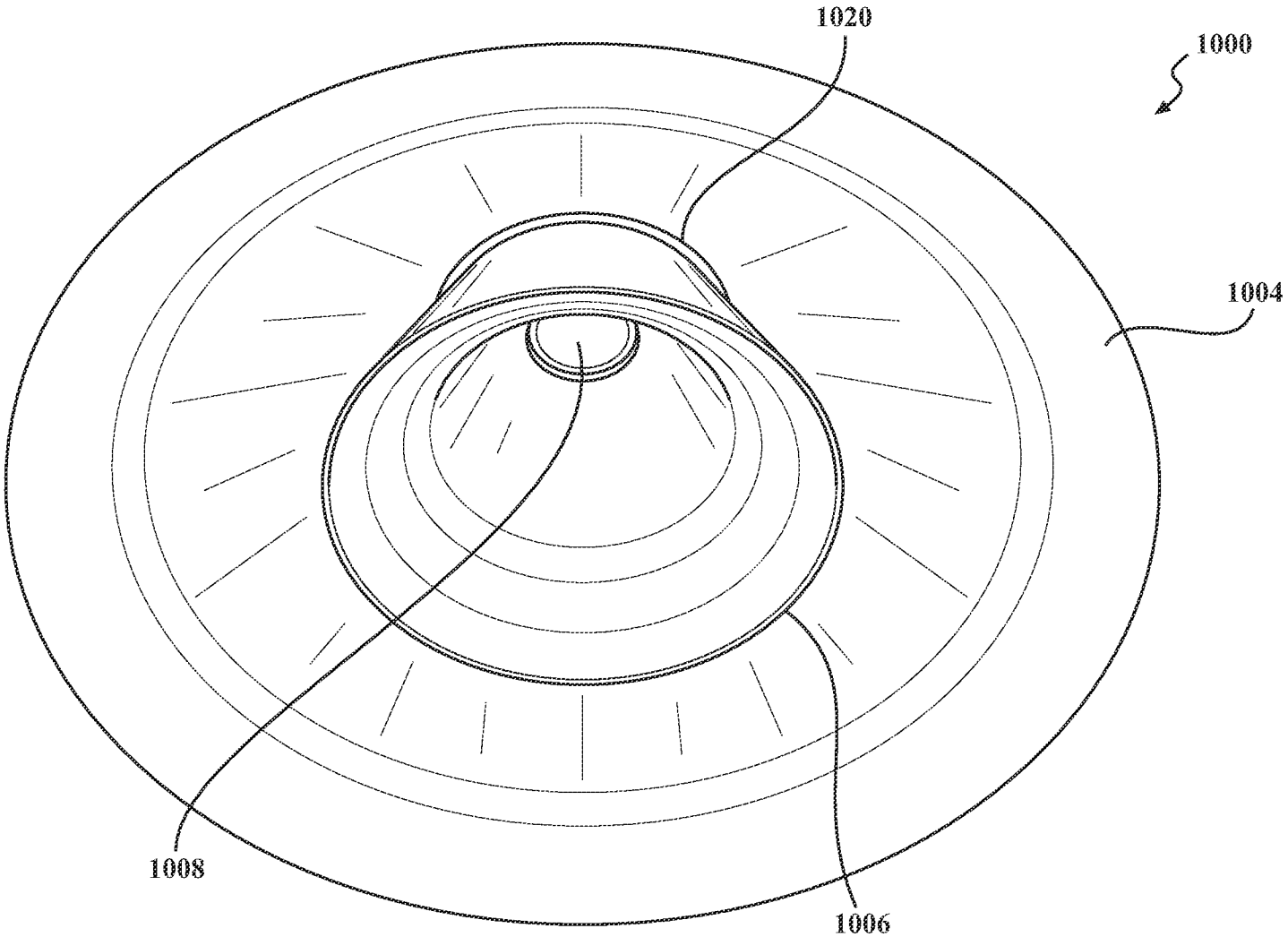
FIG. 10A is a perspective bottom view of one or more embodiments.
Figure 10B:
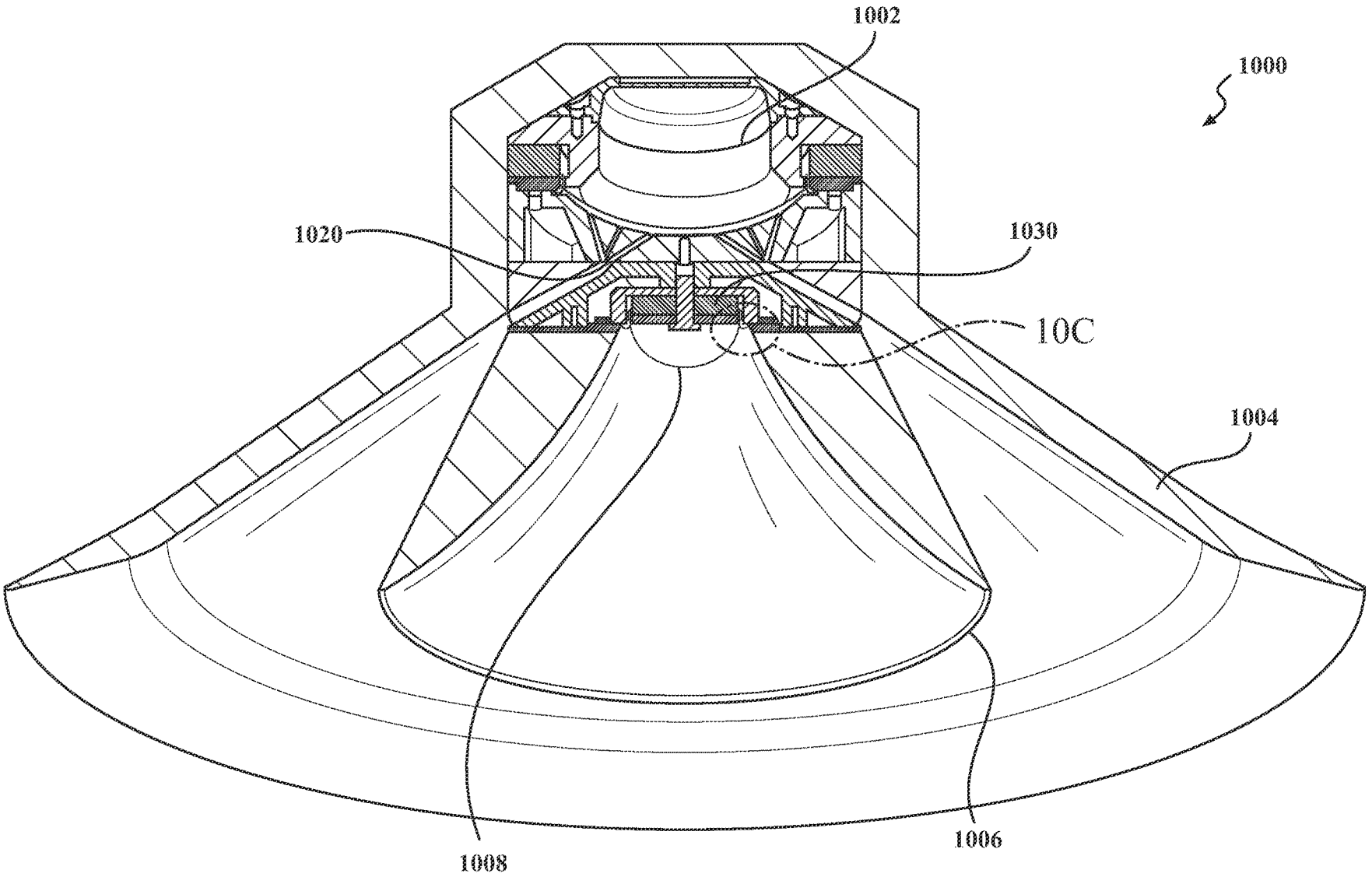
FIG. 10B is a cutaway view of one or more embodiments of the driver loaded by concentric horns.
Figure 10C:
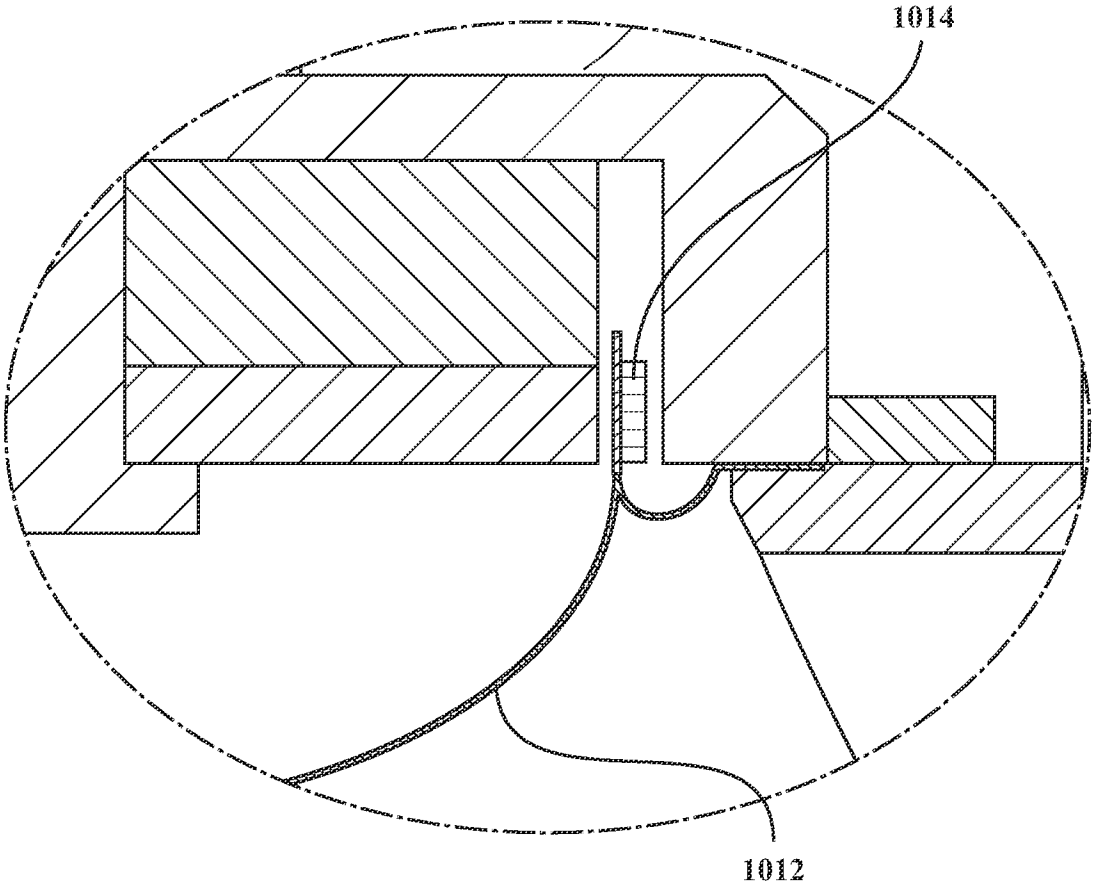
FIG. 10C is a close-up view of the inverted dome diaphragm and voice coil.

Alternatively, as shown in a perspective bottom view FIG. 10A of one or more embodiments, the driver (not shown in FIG. 10A) is loaded by a first horn 1004. A second horn 1006 and a transducer 1030 are positioned at an apex 1008 of the dispersion control assembly for down fill radiation of the compression driver 1000. FIG. 10B is a cutaway view showing the smaller second horn 1006 at an output of the dispersion control assembly. The smaller second horn 1006 provides radiation underneath the compression driver 1002. The smaller second horn 1006 has an additional transducer 1030 having a thin inverted dome diaphragm 1012 and a voice coil 1014. This configuration radiates sound towards longer distances from the compression driver 1000, providing higher SPL and polar range. In the one or more embodiments shown in FIGS. 10A and 10B, the apertures all converge into a single annular exit 1020. FIG. 10C is a close-up view of the smaller second horn 1006 and its associated inverted dome diaphragm 1012 and voice coil 1014.

Figure 11A:
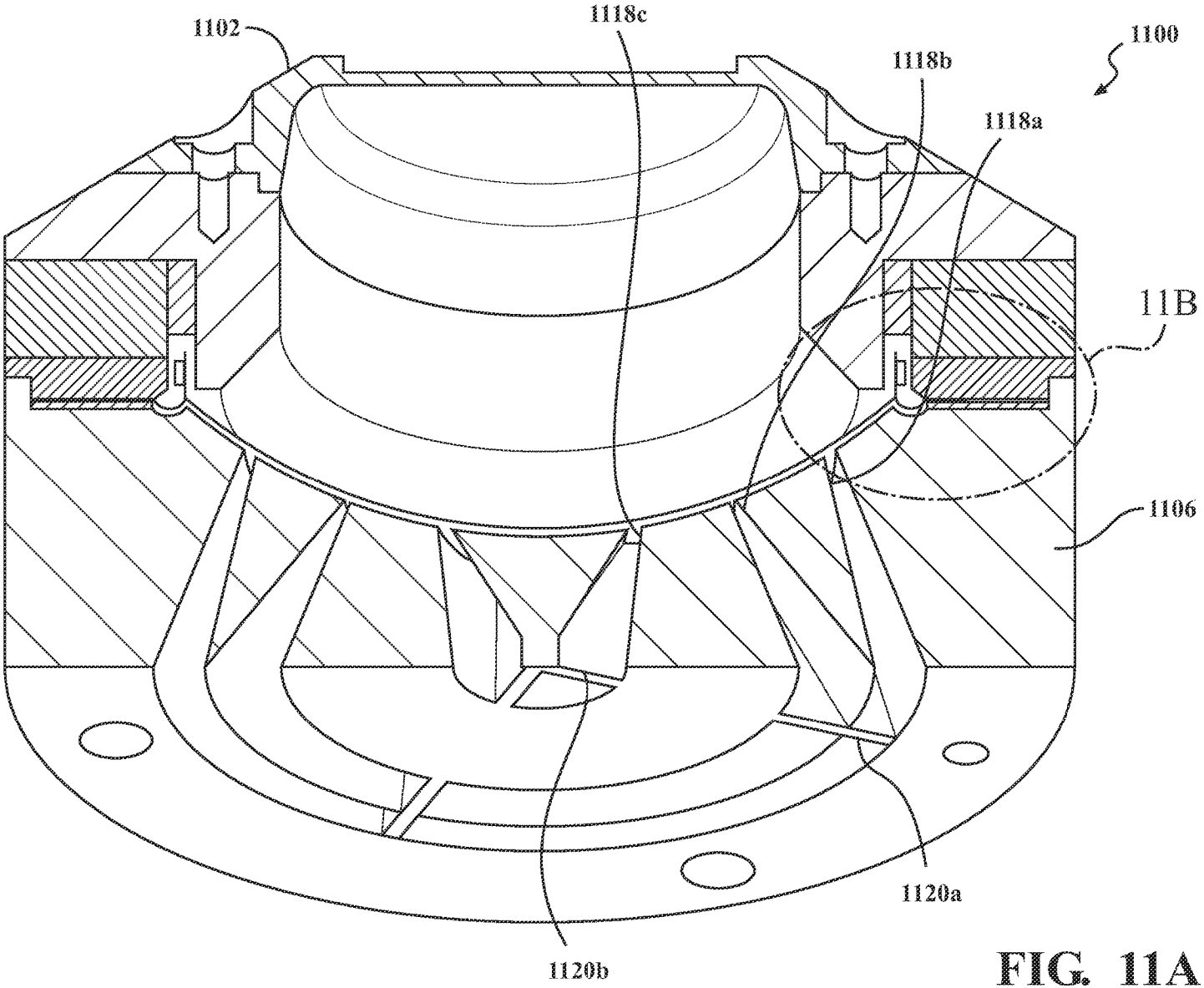
FIG. 11A is a cutaway view of one or more embodiments of the driver.
Figure 11B:
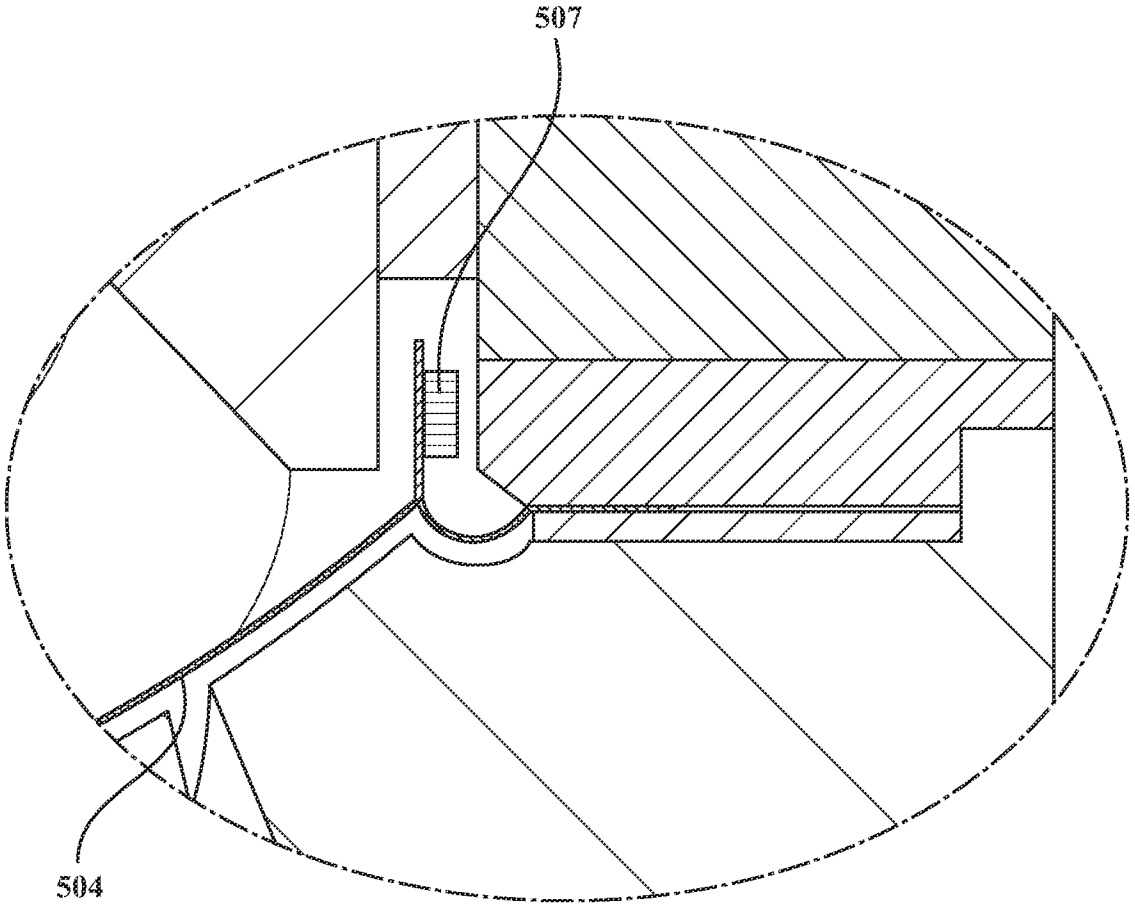
FIG. 11B is a close-up view of the inverted dome diaphragm and voice coil.

Alternatively, in one or more embodiments of a driver 1102 shown in FIG. 11A, the plurality of apertures 1118*a*, 1118*b*, and 1118*c* do not converge into a single annular exit but, instead, in the example shown in FIG. 11A, converge into separate annular exits 1120*a* and 1120*b*. There are fewer annular exits than there are concentric apertures. The separate exits 1120*a* and 1120*b* may, for example, feed two concentric horns 1124 and 1126. FIG. 11A shows one or more embodiments of a driver 1102 having a phasing plug 1106 with three apertures 1118*a*, 1118*b*, and 1118*c*. The three apertures 1118*a-c* converge into two independent annular exits 1120*a* and 1120*b*. FIG. 11B is a close-up view of the inverted dome diaphragm 504 and voice coil 507.

Figure 12A:
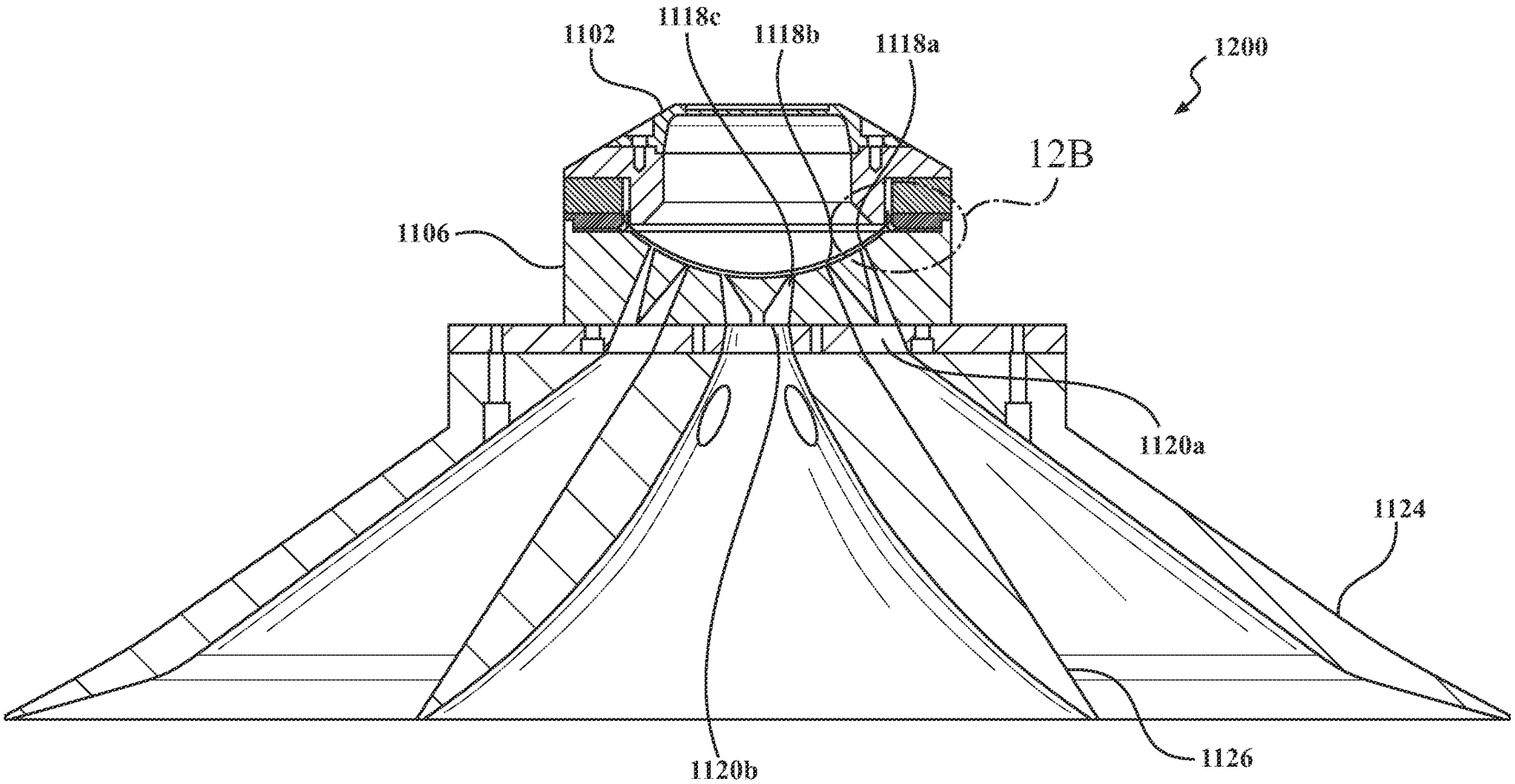
FIG. 12A is a cutaway view of the driver of FIGS. 11A and 11B loaded by concentric horns.
Figure 12B:
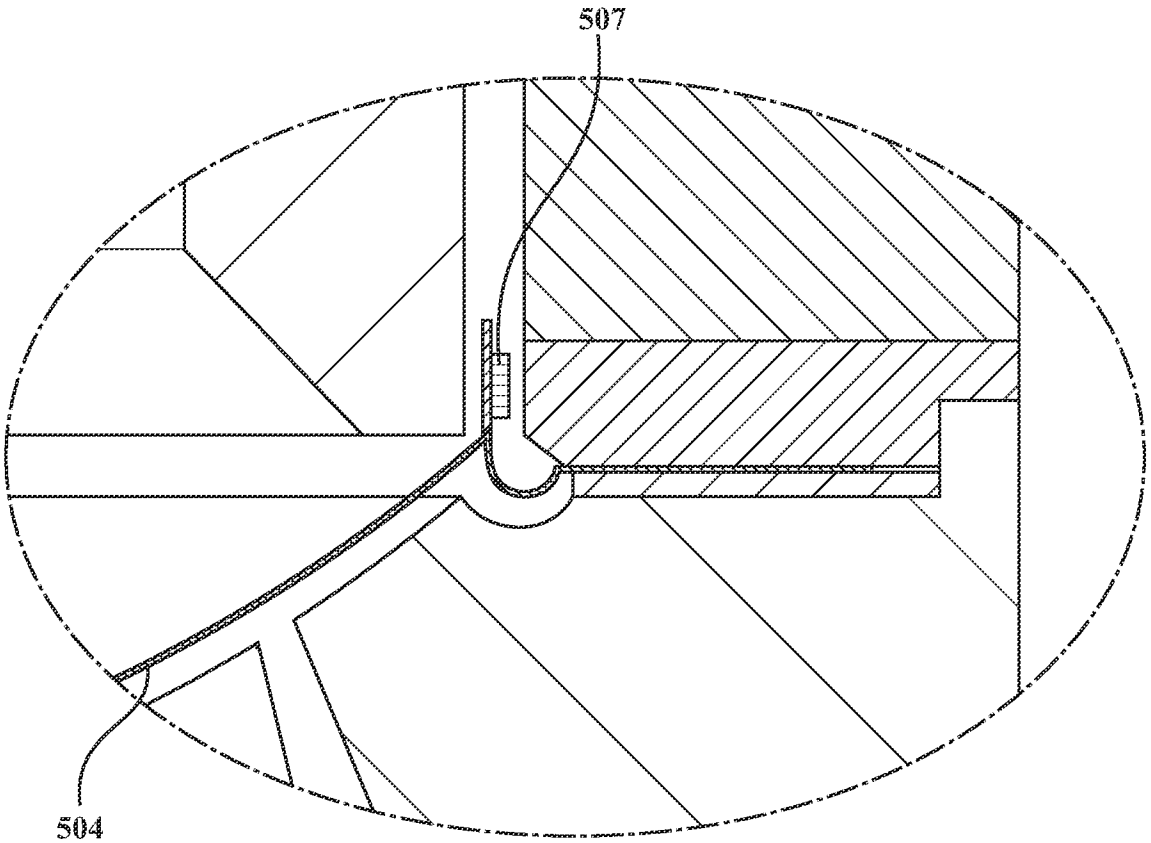
FIG. 12B is a close-up view of the inverted dome diaphragm and voice coil.

FIG. 12A is a cutaway view 1200 of the driver 1102 loaded by two concentric horns 1124 and 1126. The larger outer horn 1124 is loading an external annular exit 1120*a* having a larger area. The smaller inner, or central, horn 1126 is connected to the internal annular exit 1120*b*. FIG. 12B is a close-up view of the inverted dome diaphragm 504 and voice coil 507.

Figure 13:
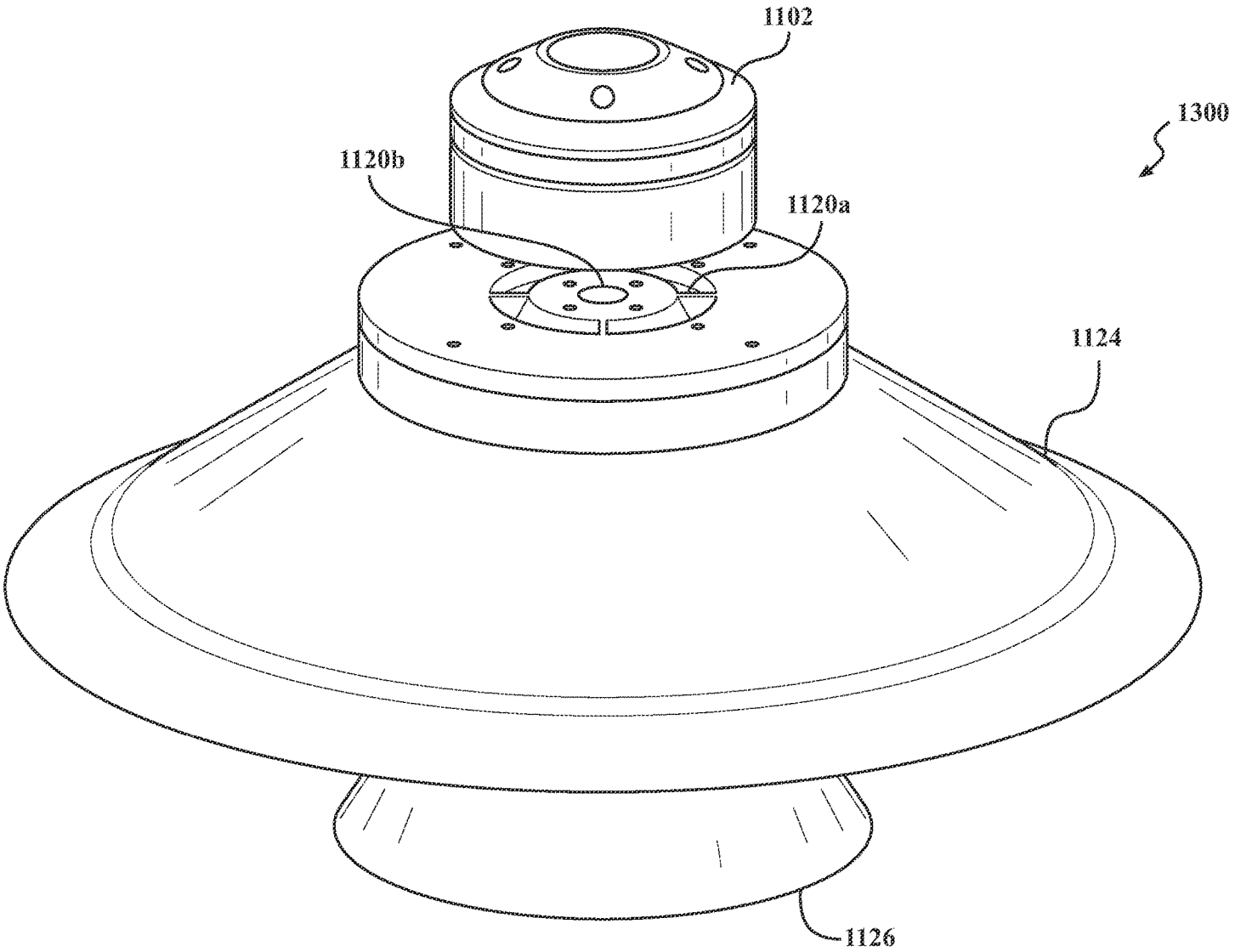
FIG. 13 is an exploded view of the driver and horns shown in FIGS. 12A and 12B.

FIG. 13 is an exploded perspective view 1300 of one or more embodiments of the driver 1102 and the two concentric horns 1124 and 1126. The smaller central horn 1126 provides radiation underneath the speaker and the larger horn 1124 radiates towards distances farther away from the speaker. The annular exit 1120*a* feeds the external horn 1124 and the annular exit 1120*b* feeds the smaller central horn 1126.

This configuration can be extended to a phasing plug with a larger number of concentric apertures. For example, for a phasing plug with four concentric apertures, two apertures would feed into the smaller central horn and two apertures would feed the external horn.

Applications for the dome diaphragm compression driver, waveguide and omnidirectional loudspeaker described herein include, but are not limited to, landscape sound systems, portable audio Bluetooth-based loudspeakers, public address systems, alarm and warning sound systems, home lifestyle loudspeaker systems, high-powered pendant speakers, negative directivity ceiling speakers, or other applications where omnidirectionality in the horizontal plane and asymmetric vertical directivity is required or desired. In comparison, annular diaphragm compression drivers having only a single exit from the compression chamber, annular apertures and a single exit are insufficient for suppressing radial resonances in the compression chamber due to its comparatively small radial dimension than that of a dome-shaped compression chamber and several concentric apertures are needed to suppress the resonances in the compression chamber.

In the foregoing specification, the present disclosure has been described with reference to specific exemplary embodiments. The specification and figures are illustrative, rather than restrictive, and modifications are intended to be included within the scope of the present disclosure. Accordingly, the scope of the present disclosure should be determined by the claims and their legal equivalents rather than by merely the examples described.

For example, the components and/or elements recited in any apparatus claims may be assembled or otherwise operationally configured in a variety of permutations and are accordingly not limited to the specific configuration recited in the claims. For example, the number, spacing and widths of the apertures and any additional horn and/or high-frequency transducers may exist in several configurations and/or combinations without departing from the scope of the inventive subject matter.

Benefits, other advantages, and solutions to problems have been described above for exemplary embodiments. However, any benefit, advantage, solution to problem or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variation thereof, are intended to reference a non-exclusive inclusion, such that a process, method, article, composition, or apparatus that comprises a list of elements does not include only those elements recited but may also include other elements not expressly listed or inherent to such process, method, article, composition, or apparatus. Other combinations and/or modifications of the above-described structures, arrangements, applications, proportions, elements, materials, or components used in the practice of the present disclosure, in addition to those not specifically recited, may be varied, or otherwise particularly adapted to specific environments, manufacturing specifications, design parameters or other operating requirements without departing from the general principles of the same.

What is claimed is:

1. A compression driver for an omnidirectional loudspeaker, the compression driver comprising:

a motor assembly disposed about a central axis;

an inverted dome diaphragm disposed about the central axis and operably connected to the motor assembly;

a phasing plug mounted to the motor assembly and having a top portion facing a convex surface of the inverted dome diaphragm and a bottom portion extending downward along the central axis; and a plurality of concentric apertures that cooperate with the convex surface of the inverted dome diaphragm and extend through the bottom portion of the phasing plug, each aperture has a predetermined radial width and is spaced a predetermined concentric distance from an adjacent aperture converging at an exit of the phasing plug; and a dispersion control assembly mounted to the bottom portion of the phasing plug along the central axis, the dispersion control assembly has a top portion having an inner surface and a bottom portion spaced a distance from and received within a cavity of the inner surface forming a waveguide arranged to radiate sound outward and downward.

2. The compression driver of claim 1, wherein the inner surface of the top portion has a plurality of arms radiating to create channels in the waveguide.

3. The compression driver of claim 1, wherein the plurality of concentric apertures further comprises each aperture converging into a single annular exit in the phasing plug.

4. The compression driver of claim 3, wherein the phasing plug has at least three concentric apertures.

5. The compression driver of claim 1, wherein the plurality of concentric apertures further comprises at least two apertures converging at a first point and one or more of the remaining apertures in the plurality of concentric apertures converge at a second point below the first point, the first and second points of convergence merge into a single aperture thereby creating a single annular exit.

6. The compression driver of claim 5, having at least four concentric apertures, two of the at least four concentric apertures converge at the first point and two of the at least four concentric apertures converge at the second point.

7. A waveguide for an omnidirectional loudspeaker, the waveguide comprising:

a phasing plug having a top portion cooperating with a convex surface of an inverted dome diaphragm and a bottom portion extending downwardly from the top portion along a central axis, the phasing plug has a plurality of concentric apertures cooperate with a compression chamber between the convex surface of the inverted dome diaphragm and the top portion of the phasing plug, each aperture has a predetermined radial width and is spaced a predetermined concentric distance from an adjacent aperture, the plurality of concentric apertures converge at a single annular opening in the bottom portion; and a dispersion control assembly mounted to the bottom portion of the phasing plug along the central axis, the dispersion control assembly has a top portion and a bottom portion, the bottom portion is spaced a distance from and received within a cavity of the top portion forming an annular pathway for sound to radiate.

8. The waveguide of claim 7, further comprising a plurality of arms radiating outward on an inner surface of the top portion forming a plurality of channels in the waveguide.

9. The waveguide of claim 7, having at least three concentric apertures.

10. The waveguide of claim 7, wherein the plurality of concentric apertures further comprises at least two apertures converging at a first point and one or more of the remaining apertures converging at a second point that is vertically below the first point, the first and second points of convergence merge into a single aperture within the top portion of the phasing plug thereby creating a single annular exit that matches the opening of the bottom portion.

11. The waveguide of claim 10, having at least four concentric apertures, wherein two of the four concentric apertures converge at the first point and two of the four concentric apertures converge at the second point.

12. An omnidirectional loudspeaker, comprising:

a first horn; and a compression driver attached to the first horn, the compression driver comprising:

a motor assembly disposed about a central axis;

an inverted dome diaphragm disposed above and operably connected to the motor assembly;

a phasing plug mounted to the motor assembly and having a top portion facing a convex surface of the inverted dome diaphragm and a bottom portion extending downward from the top portion along the central axis;

a plurality of concentric apertures extends through the phasing plug, each aperture has a predetermined radial width and is spaced a predetermined concentric distance from an adjacent aperture, the plurality of concentric apertures converge into a single annular exit in the bottom portion of the phasing plug; and a dispersion control assembly mounted to the bottom portion of the phasing plug along the central axis, the dispersion control assembly has a top portion and a bottom portion, the bottom portion is spaced a distance from and received within a cavity of the top portion forming an annular pathway for sound to radiate.

13. The omnidirectional loudspeaker of claim 12 wherein the dispersion control assembly further comprises a plurality of radiating arms on an inner surface of the top portion forming a plurality of channels in the annular pathway.

14. The omnidirectional loudspeaker of claim 12, wherein the phasing plug has at least three concentric apertures.

15. The omnidirectional loudspeaker of claim 12, wherein the plurality of concentric apertures further comprises at least two apertures converging at a first point and one or more of the remaining apertures converging at a second point below the first point, the first and second points of convergence merge into a single aperture at an exit of the phasing plug thereby creating a single annular exit.

16. The omnidirectional loudspeaker of claim 12, further comprising a bullet tweeter mounted to the phasing plug along the central axis.

17. The omnidirectional loudspeaker of claim 12, further comprising a second horn mounted to the phasing plug along the central axis.

18. The omnidirectional loudspeaker of claim 17, further comprising a tweeter attached to an apex of the second horn.

* * * * *